United States Patent [19]

Morel

[11] Patent Number: 4,917,133

[45] Date of Patent: Apr. 17, 1990

[54] APPLICATOR CASE FOR LIPSTICK AND SIMILAR APPLICATIONS

[76] Inventor: Simone Morel, 15 rue du Faubourg de Paris, 51210 Montmirail, Marne, France

[21] Appl. No.: 289,661

[22] Filed: Dec. 8, 1988

Related U.S. Application Data

[63] Continuation of Ser. No. 60,282, Jun. 10, 1987, Pat. No. 4,815,485.

[30] Foreign Application Priority Data

Jun. 3, 1987 [FR] France ..... 87 07762

[51] Int. Cl.[4] ..... A45D 40/00

[52] U.S. Cl. ..... 132/318; 401/61; 401/62; 401/102

[58] Field of Search ..... 132/318; 401/61, 59, 401/62, 102

[56] References Cited

U.S. PATENT DOCUMENTS

| | | | |
|---|---|---|---|
| 2,088,899 | 8/1937 | Chevreau | 401/62 |
| 2,168,876 | 8/1939 | Noyack | 401/61 |
| 2,178,279 | 10/1939 | Fullmer | 401/102 |
| 2,349,799 | 5/1944 | Lee | 401/61 |
| 2,393,677 | 1/1946 | Gelardin | 401/61 |
| 2,395,709 | 2/1946 | Anderson | 401/61 |
| 2,511,962 | 6/1950 | Broder | 401/61 |
| 2,512,476 | 6/1950 | Birnkrant et al. | 431/79 C |
| 2,609,093 | 9/1952 | Kynn | 401/61 |
| 2,776,051 | 1/1957 | Warren, Jr. | 401/61 |
| 2,872,034 | 2/1959 | Harris | 401/61 |
| 2,924,219 | 2/1960 | Wershaw | 132/79 C |
| 3,021,946 | 2/1962 | Harris | 401/61 |

FOREIGN PATENT DOCUMENTS

| | | | |
|---|---|---|---|
| 1181867 | 11/1964 | Fed. Rep. of Germany | 401/61 |
| 394519 | 11/1965 | Switzerland | 401/61 |
| 1180424 | 2/1970 | United Kingdom | 132/318 |

*Primary Examiner*—Cary E. Stone

*Attorney, Agent, or Firm*—Browdy and Neimark

[57] ABSTRACT

The applicator case for lipstick and similar applications comprises a body defining a base forming a bottom. The base is extended by an envelope having a slot and forming a guide for a sheath defining a protrusion extending through the slot of the envelope. The sheath has a length less than that of the envelope and forms an inner ring against which abuts the lipstick and similar applications.

10 Claims, 2 Drawing Sheets

APPLICATOR CASE FOR LIPSTICK AND SIMILAR APPLICATIONS

This is a continuation of Ser. No. 060,282, filed 6/10/87, now U.S. Pat. No. 4,815,485.

The present invention relates to a new applicator case for lipsticks and similar applications, for example sticks for applying various make-ups.

BACKGROUND OF THE INVENTION

In order to make known to the public the shade as well as the perfume or other features of new products, the perfume and cosmetics industries distribute free samples which are either sent by post, or distributed in buildings, or still offered in specialized shops.

Such samples have to be of a low cost in order to be distributed in larger numbers, or, when perfume or cosmetics products are sold in miniaturized form, as this is frequently the case in present so-called fashion shops, it is important that the stick or rouge of cosmetic or perfume product is of a very small volume and conveniently held by a person so as to be easily used in the same manner as a currently used product.

The miniaturization of the cases or distributors of perfumes and cosmetic products aims also at enabling the women users, particularly in holiday resorts or places of short stay such as beaches, to have available lipsticks and various make-ups which can be placed in small size pouches or kept in a belt or a swimsuit pocket.

The invention solves the hereabove problem by making possible at a same time a miniaturization of a case and a holding in a strong manner of the perfumery or cosmetology product, and this while imparting to the case an attractive appearance despite its low cost price.

SUMMARY OF THE INVENTION

According to the invention, the applicator case for lipstick and similar applications comprises a body defining a base forming a bottom, the base being extended by an envelope having a slot and forming a guide for a sheathe defining a protrusion extending through the slot of the envelope ; the sheathe, which has a length less than that of the envelope, forming an inner ring against which abuts the lipstick and similar applications.

Various other features of the invention will become more apparent from the following detailed description.

BRIEF DESCRIPTION OF THE DRAWINGS

Embodiments of the invention are shown, by way of non limiting examples, in the accompanying drawings, wherein.

DETAILED DESCRIPTION OF THE INVENTION

Figure 1:
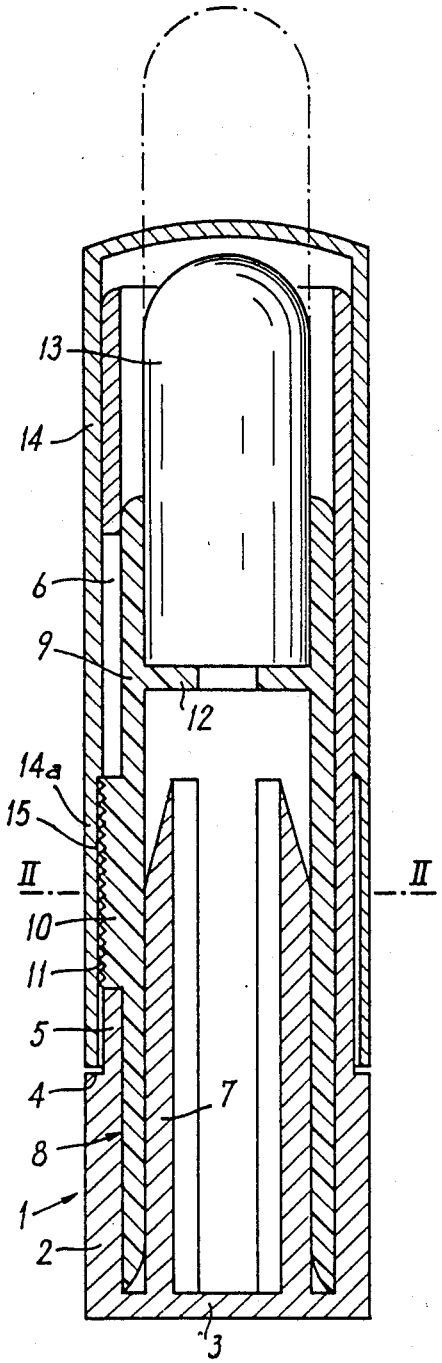
FIG. 1 is an elevation cross-sectional view of a lipstick applicator case according to the invention.

The applicator case comprises a body generally designated by reference numeral 1. The body 1 is preferably of a cylindrical section and comprises a base 2 forming a bottom 3.

The upper portion of the base 2 is cut off for defining a shoulder 4 and an envelope 5 The envelope 5 is provided in its wall with a longitudinal slot 6.

The body 1 is insidely formed with a core 7 defining, with the base 2 and a portion of the envelope 5, an arcuate housing 8.

The core 7 can extend over a portion of an arc, as shown in the drawings or can be annular in shape.

The arcuate housing 8 and core 7 form, together with the base 2 and envelope 5, guiding means for a sheath 9 having a protrusion 10 extending through the slot 6 and being used as a slider.

It is advantageous that a top of the protrusion 10 is knurled or made rough in any other way, as shown at 11, and protrudes slightly with respect to the outer generating lines of the envelope 5, so as to be easily handled, for example with the thumb of a user of the case.

In FIG. 1, the length of the sheath 9 is advantageously chosen for constantly closing the slot 6, whatever is a position of the protrusion 10 in the slot 6. One is thus sure that foreign bodies are prevented from reaching the inside of the sheath 9 through the slot 6.

Figure 4:
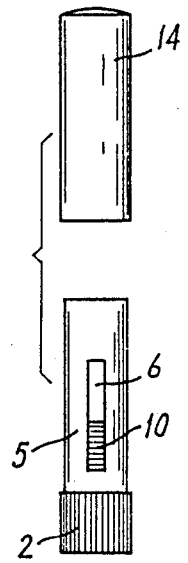
FIG. 4 is an exploded elevation view of the applicator case and of its cap.

The sheath 9 defines, above the core 7, a ring 12 forming an abutment for a lipstick or rouge 13, or any similar product, which protrudes clearly above the end of the sheath 9, but which does not protrude from the envelope 5, or only a little, when the protrusion 10 is at the lower portion of the slot 6, as shown in FIGS. 1 and 4.

The envelope 5 is covered by a removable cap 14 having a skirt, the bottom **14*a* of which skirt is formed with one, and preferably several, grooves 15 having a width corresponding to that of the protrusion 10**.

The inner wall of the cap 14, which is adapted for entirely covering the envelope 5 as well as the stick 13, has an inner wall cooperating with an outer wall of the envelope 5 in such a manner that a non negligible friction will exist between these walls, so that the cap can be held in position only by friction.

One would not however depart from the scope of the invention by providing retaining means between the cap 14 and envelope 5, for example retaining rings and grooves or other means known in this art.

Figure 3:
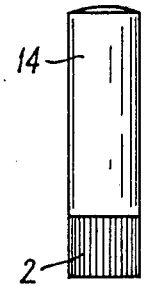
FIG. 3 is an elevation view of the applicator case, in a closed position.

Although not indispensable, it is advantageous, as shown in the drawings and particularly in FIG. 3, that the cap 14 and base 2 have their generating lines in alignment when the cap is in position.

Figure 5:
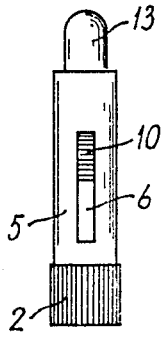
FIG. 5 is an elevation view of the applicator case, in a position of use.

When the case is of a very small size, for example less than one centimeter in diameter and from 2 to 5 cm in height, the base 2 is of course very short. For making a gripping of the base 2 easy, it is advantageous to have the base 2 serrated or made rough in any other manner, as shown in FIGS. 3 to 5.

In order to use the stick 13, the only thing to do, when the cap 14 has been removed, as shown in FIG. 4, is to press the protrusion 10 forming a slider so as to displace it within the slot 6 and bring out the stick 13 which, according to its nature, can be used as rouge, make-up or other similar products.

Figure 2:
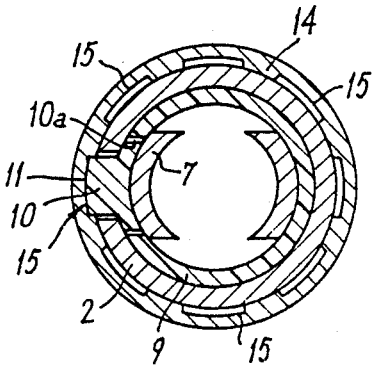
FIG. 2 is a cross-sectional view substantially along line II—II of FIG. 1.

For making the case, it is advantageous to manufacture some of the parts at least, for example the envelope 5, from a relatively flexible material, typically a synthetic material. Thus, the sheath 9 which comprises the protrusion 10 forming a slider can be mounted by forcibly engaging the protrusion 10 inside the envelope 5, the mounting being thus made by a resilient deformation of the sheath 9 and/or the envelope 5. It is also possible to provide longitudinal slots 10*a* (FIG. 2) on either side of the slider 10.

In an alternative embodiment, the protrusion 10 forming a slider has its top flush with the outer wall of the envelope 5, or even slightly set back, and the cap 14 and envelope 5 form respective tightness means. In such a case, the cap 14 has no grooves. This arrangement is such that the case is watertight when closed, thereby enabling a user to bathe While preserving all the properties of the stick or rouge of perfumery or cosmetology product.

Figure 6:
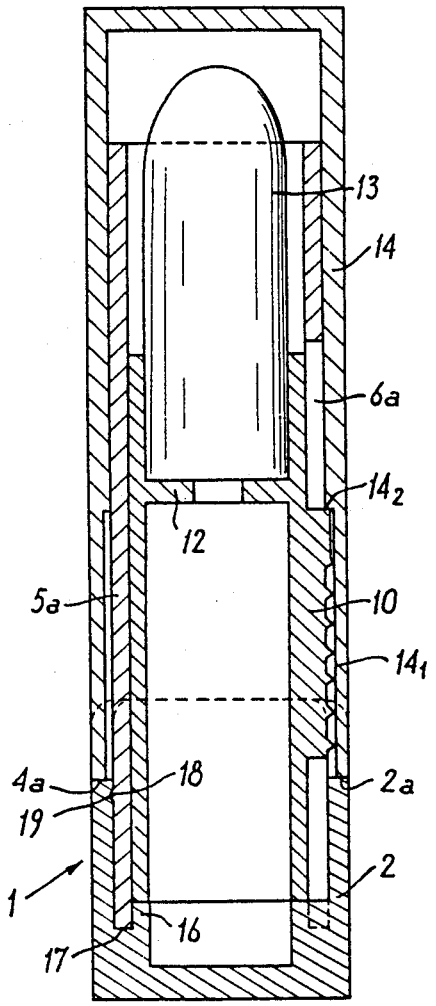
FIG. 6 is an elevation cross-sectional view of a lipstick applicator case according to an alternative embodiment of the invention.
Figure 7:
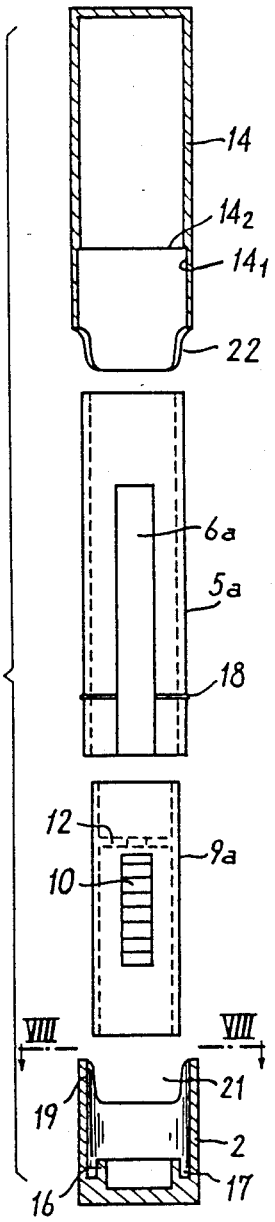
FIG. 7 is an exploded elevation view, partly in cross-section, of the constituent parts of the applicator case of FIG. 6.
Figure 8:
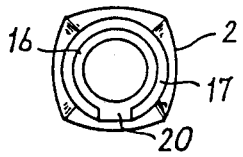
FIG. 8 is a top view along line VIII—VIII of FIG. 7.

In the very same manner as in FIGS. 1–5, the applicator case 1 shown in FIGS. 6 to 8 has a body generally designated also by reference numeral 1. The body 1 is made of a base 2, described in more detail in the following disclosure, and an envelope 5*a* defining with the base 2 a shoulder 4*a*. The envelope 5*a* is formed in its wall with a longitudinal slot 6*a* extending down to the bottom of the envelope 5.

As shown in FIG. 7, the base 2 is insidely provided with a ring 16 defining a groove 17 inside which is engaged a lower portion of the envelope 5*a*. Preferably, the envelope 5*a* includes a snap ring 18 in correspondence with a groove 19 formed in an inner wall of the base 2. The snap ring 18 forms a locking device for the envelope 5*a* when engaged on the other hand with a tight-fit inside the groove 17.

When it is desired that the envelope 5*a* is placed in a determined angular position with respect to the envelope 5*a*, the ring 16 is connected to the side wall of the base 2 by a key 20 corresponding in width to the longitudinal slot 6*a*. The envelope 5*a* is used for housing a sheath 9*a* having a protrusion 10 extending through the longitudinal slot 6*a* of the envelope 5*a*.

The sheath 9*a* comprises a ring 12 forming an abutment for a lipstick or rouge 13 or any similar product which extends substantially above the end of the sheath 9*a* but which does not protrude from the envelope 5, or only a little, when the protrusion 10 is in a lower portion of the slot 6*a*, as shown in FIG. 6.

FIG. 6 shows also that the sheath 9*a* comes to rest on top of the ring 16 when the protrusion 10 is at the lower portion of the longitudinal slot 6*a*. The envelope 5*a* is covered by the removable cap 14 guided by the outer wall of the envelope 5*a* and which comes to rest against an upper edge 2*a* of the base 2.

The lower portion of the inner wall of the removable cap 14 has a larger diameter as shown at $14_1$ in the drawings, so as to take into account the offset of the protrusion 10 used for moving the envelope 5*a* and, consequently, the lipstick 13. The shoulder $14_2$ between the enlarged part $14_1$ and the inner wall of the removable cap 14 is provided to bear on the top of the protrusion 10, Which makes possible to make the sheath 9*a* to slide upon closing while preventing to damage the lipstick 13 even if the user has not handled the protrusion 10 forming a slider.

From the hereabove disclosure, it is clear that, for mounting the case, the lipstick 13 is placed inside the sheath 9*a*, and the sheath 9*a* is engaged inside the envelope 5*a*, with the protrusion 10 sliding in the longitudinal slot 6*a*. Thereafter, the envelope 5*a* is engaged in the base 2 in which it is locked by the snap ring 18. In the position described, the lipstick 13 can be used by sliding the sheath 9*a* inside the envelope 5*a* in which it is guided with a slight fit. When the lipstick 13 is not used, the cap 14 is set in position.

The embodiment hereabove described makes it possible to have a case of various shapes. For example, it can be of a circular cross-section or of a substantially square cross-section with rounded sides, as shown. Moreover, the parts being perfectly guided with respect to each other, various patterns can be realized. For example and as shown in FIG. 7, the base 2 can be formed with notches 21 in two of its sides and the cap 14 can be formed with mating notches 22 in its two opposite sides, thereby providing a fit of the cap 14 with respect to the base 2 by preventing those two parts from rotating relative to each other when fitted into each other.

By appropriately chosing the shape of the notches, it is also possible to impart a particular aesthetic appearance to the case.

What is claimed is:

1. An applicator case for lipstick and similar applications, comprising a body defining a base forming a bottom, said base being extended by an envelope having a slot, said envelope forming a guide for a sheath defining a protrusion extending through the slot of the envelope, said sheath having a length smaller than that of the envelope and forming an inner ring against which abuts the lipstick and similar applications, wherein the base defines a groove for an introduction of a lower portion of the envelope, the envelope being inserted within said groove and having an outer wall cooperating with a cap, and wherein the cap has in inner wall having at least one recess for passage of the protrusion, said protrusion extending slightly beyond an inner wall of the envelope and defining, with said recess in the cap, means to longitudinally slide the sheath within the body of the applicator case upon inserting the cap on said envelope.

2. The case as set forth in claim 1, wherein the slot is a longitudinal slot having a base opened for enabling a passage of the protrusion of the sheath.

3. The case as set forth in claim 1, wherein the envelope comprises a locking snap ring engaged inside a groove of the base.

4. The case as set forth in claim 1, wherein the base forms a ring for defining the groove of the base, said ring being connected to an outer wall of the base by a key having wide corresponding to that of the slot of the envelope for ensuring an angular locking of the envelope with respect to the base.

5. The case as set forth in claim 4, wherein the ring forms an abutment for the sheath.

6. The case as set forth in claim 1, wherein the base and the cap are formed with complementary notches.

7. The case as set forth in claim 1, wherein outer generating lines of the base and cap are in alignment.

8. The case as set forth in claim 1, wherein the cap is maintained on the envelope by friction.

9. The case as set forth in claim 1, wherein an outer wall of the base is slotted or otherwise made rough.

10. The case as set forth in claim 1, wherein tightness means are provided between the envelope and the cap.

* * * * *